US006775854B2

(12) United States Patent
Nishikawa et al.

(10) Patent No.: US 6,775,854 B2
(45) Date of Patent: Aug. 17, 2004

(54) TOILET COVER OPENING/CLOSING DEVICE

(75) Inventors: Kazunori Nishikawa, Nagano (JP); Hiroshi Yamada, Nagano (JP)

(73) Assignee: Sankyo Seiki Mfg. Co., Ltd., Nagano-ken (JP)

( * ) Notice: Subject to any disclaimer, the term of this patent is extended or adjusted under 35 U.S.C. 154(b) by 0 days.

(21) Appl. No.: 10/602,297

(22) Filed: Jun. 24, 2003

(65) Prior Publication Data

US 2004/0060104 A1 Apr. 1, 2004

(30) Foreign Application Priority Data

Jun. 24, 2002 (JP) ..... 2002-183424

(51) Int. Cl.[7] ..... A47K 13/10
(52) U.S. Cl. ..... 4/246.1; 4/248
(58) Field of Search ..... 4/241, 246.1–246.5, 4/248

(56) References Cited

U.S. PATENT DOCUMENTS 6,067,667 A * 5/2000 Suzuki ..... 4/246.1

FOREIGN PATENT DOCUMENTS

JP 10211121 A * 8/1998 ..... A47K/13/10
JP 11032945 A * 2/1999 ..... A47K/13/12
JP 11-076103 3/1999
JP 11-076105 3/1999

* cited by examiner

*Primary Examiner*—Tuan N. Nguyen
(74) *Attorney, Agent, or Firm*—Reed Smith LLP

(57) ABSTRACT

A closing device for a toilet unit includes a slave member connected to a toilet cover, a motor, and a switching mechanism that mechanically connects or disconnects the motor from the slave member during closing of the cover. When the motor rotates to move the toilet cover from an open position to a partially closed position, the switching mechanism allows the slave member to move in response to rotation of the motor. After the toilet cover reaches the partially closed position, the mechanical link between the slave member and the motor provided by the switching mechanism is released such that the toilet cover falls freely under its own weight to the closed position independent of the motor. Preferably, the device includes a driving member coupled between the motor and the switching mechanism and operable to move the slave member. The motor rotates in the reverse direction to return the driving member to a position corresponding to the open position of the toilet cover such that during opening of the toilet cover by a user, the slave member is mechanically disconnected from the driving member to reduce the amount of force required to open the toilet cover.

15 Claims, 5 Drawing Sheets

OPEN

OPEN → CLOSE

CLOSE
CCW
CW
20
41
45
50
51
73
92
96
97

TOILET COVER OPENING/CLOSING DEVICE

FIELD OF THE INVENTION

The present invention relates to a toilet cover opening/closing device by which the toilet cover in the fully opened state is moved by a motor to a point in the closing direction and then rotates until it is in the fully closed state being initiated by the weight of the toilet cover itself.

BACKGROUND OF THE INVENTION

The present invention relates to a toilet cover opening/closing device by which the toilet cover in the fully opened state is moved by a motor to a point in the closing direction and then rotates until it is in the fully closed state being initiated by the weight of the toilet cover itself.

When one visits a toilet and sees a toilet cover wide open, he or she will not be impressed with it and it is not sanitary either. Moreover, when a heater is built into the toilet seat, power consumption increases during the time the toilet cover is left open. To solve these problems, a variety of toilet cover opening/closing devices for automatically closing a wide-open toilet cover have been proposed.

Japanese Laid-open patent application No. H11-76103 is an example that discloses a toilet cover in which a motor moves a wide-open toilet cover to a point in the closing direction, and then, the toilet cover rotates (to a fully closed position) by its own weight. Here, gears mechanically connect all the components, motor through the rotary shaft of the toilet cover, and a torque limiter, provided in the middle of the force transmission path, turns on a motor until the toilet cover starts rotating under its weight and automatically turns off the motor as soon as the toilet cover reaches the point at which the self-weight initiated rotational motion begins. Nonetheless, the moment of the toilet cover is larger than the torque generated by the torque limiter, idling the torque limiter. Nothing prevents the toilet cover from making the self-weight initiated rotational motion in the closing direction. Further, to prevent sudden closure of the toilet cover, the rotary shaft of the toilet cover is always connected to a shock absorber through gears to respond to the shock absorber.

Japanese Laid-open patent application No. H11-76105 discloses another type in which a motor drives both a toilet cover and a shock absorber in an attempt to prevent a sudden closure of a toilet seat. As the toilet cover reaches the point where its self-weight initiates closing motion, the friction mechanism in the shock absorber breaks the rotational (closing) motion of the shock absorber itself to cause an idle spin until the timer stops the motor. In this mechanism, the toilet cover quietly closes due to the resistance from the shock absorber when the toilet cover makes the self-weight initiated rotary motion in the closing direction.

Nevertheless, in light of the above problems of conventional technologies: the former type assumes an idle spin of the torque limiter every time the toilet cover makes an opening or closing motion, requiring an expensive torque limiter with very high durability. Further, the point where the magnitude of torque of the torque limiter exceeds the moment of the toilet cover is a point where the toilet cover initiates its self-weight rotational (closing) motion: the declination starting point fluctuates due to inconsistency of torque that the torque limiter provides or (an additional variable such as) a (textile or knit) cover attached to the toilet cover, complicating the method of controlling the motor. Further, when a user manually opens the toilet cover connected to a motor, he must always apply a force that is larger than the torque generated by the torque limiter. This adversely affects handling ease of the toilet cover.

The former type assumes the shock absorber to rotatably support the toilet seat and toilet cover, as a result, the shock absorber is loaded with a large external force. To rotate the shock absorber itself, the joint between the guide portion in the rotation mechanism and the motor must be made very rigid. Moreover, a user manually opens the toilet cover initially taking advantage of the toilet cover's moment, which is the initial main load, however, he must apply a force large enough to overcome the friction mechanism built into the motor to rotate the shock absorber itself later. In this method, the torque suddenly increases in the middle of the motion. This also adversely affects the handling ease of the toilet cover.

To overcome the above problems, it is desirable to provide an affordable toilet cover opening/closing device having a simple configuration with greatly improved handling ease thereof at the time of manual opening.

SUMMARY OF THE INVENTION

As a means to solve the above problems, the present invention provides a toilet cover opening/closing device that comprises: a rotary shaft for moving the toilet cover; and a driving means for rotating the rotary shaft to provide a rotational motion to the toilet cover from an inclined starting position where the toilet cover starts rotating in the closing direction by its own weight. The driving means further comprises: a motor that is rotatable both clockwise and counterclockwise; a driving member that is connected to the output shaft end of the motor; a slave member that is connected to the rotary shaft end; and a switching mechanism mechanically connecting or disconnecting the driving member with the slave member. When the motor rotates clockwise to lift the toilet cover from the fully opened position to the inclined starting position, the switching mechanism allows the slave member to move in response to the driving member. After the toilet cover reaches the inclined starting position, the mechanical linkage between the driving member and the slave member is released. As a result, the slave member moves in accordance with the self-weight initiated rotary motion of the toilet cover independent if the driving member and the driving member returns to its fully opened position in the toilet cover independent of the slave member taking advantage of the motor's reversed spin.

Assume that one wants to rotate the toilet cover that is kept wide open as a result of the motor's clockwise rotational motion in the closing direction. The driving member connected to the motor end and the rotary shaft end of the toilet cover are mechanically connected via a switching mechanism; the motor driving the rotational motion of the toilet cover in the closing direction. After the toilet cover reaches the point of self-weight initiated inclination, the switching mechanism mechanically disconnects the driving member and the slave member. In this configuration, the slave member being independent of the driving member can move in response to the self-weight initiated rotational motion of the toilet cover, and at the same time, the driving member being independent of the slave member returns to its original position, which is the fully opened position of the toilet cover. As a result, when a user manually opens the toilet cover, a responsive motion occurs at the slave member but not at the driving member connected to the output shaft end of the motor. The toilet cover can thus be closed with a minimum effort. In addition, the closure of the toilet cover can be minimal only by releasing the linkage between the driving member and the slave member. The method of controlling a motor can thus be made easy and the manufacturing of the mechanism can thus be cost effective.

In this invention, the switching mechanism has a structure, for example, in which the driving member pushes the slave member to move the toilet cover from the fully opened position to the inclined starting position, wherein the slave member and the driving member do not interfere with each other as long as the toilet cover's self-weight initiates the motion of the slave member defined by the inclined starting position and the fully closed position.

In this invention, the switching mechanism has a structure in which a groove is provided on the driving member in such a manner that a part of the slave member makes a relative linear motion therein to move in response to the driving member when the toilet cover moves from the fully opened position to the inclined starting position. The shape and length of the groove from one edge to the other edge is set so as to cause: (1) the motor's reversed spin providing the slave member with a rotational motion independent of the driving member after the toilet cover rotates from the fully opened position to an inclined starting position; and (2) the driving member is capable of returning to its original position independent of the slave member.

In this invention, it is preferable that the toilet cover further comprises a shock absorber for applying a resisting force to the self-weight initiated rotational motion exercised in the closing direction such that the speed of the self-weight initiated rotational motion that occurs between the inclined starting position and ends in the fully closed position is slowed down. In this configuration, a large noise does not occur at the time the toilet cover makes the self-weight initiated rotational motion in the closing direction. In this way, the toilet cover will not be damaged either.

For the motor of this invention, a stepping motor is preferable. This configuration causes the stepping motor to lose synchronism with the motion even though manual opening of the toilet cover interrupts the motor driven closing rotary motion. As a result, the user can open the toilet cover with little effort even though opening applies a force against the motor's spinning direction.

In this invention, it is further preferable that the toilet cover further comprises a stopper that mechanically defines the original position and the end position of the driving member, which is in line with the rotational motion of the driving member that occurs between the fully opened position and the inclined starting position. In this configuration, when the motor driven closing motion of the toilet cover encounters an opening motion manually applied thereto resulting in displacement of the toilet cover from the target position that meets the duration of time the motor was on, the motor makes a reversed spin to initialize the position of the toilet cover utilizing the stopper. In this way, the next motion of the toilet cover can normally be driven. By controlling steps or a time, the toilet cover opening/closing device of the present invention thus accurately repeats the same motion all the time.

DETAILED DESCRIPTION OF THE INVENTION

The toilet cover opening/closing device of the present invention is described herein with reference to the drawings.

Figure 1:
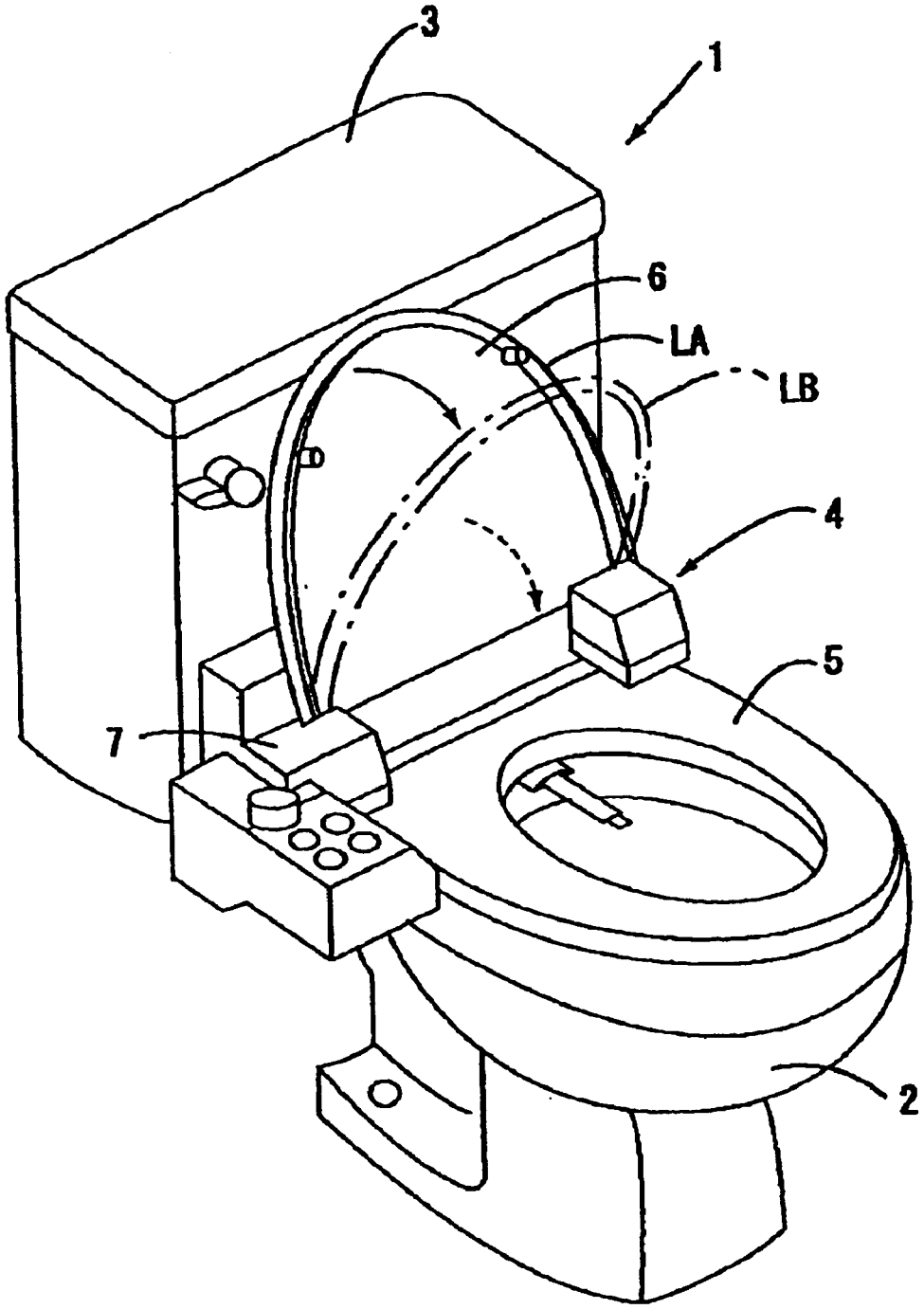
FIG. 1 is a diagram illustrating a toilet seat unit having a toilet cover opening/closing device of the present invention.
Figure 2:
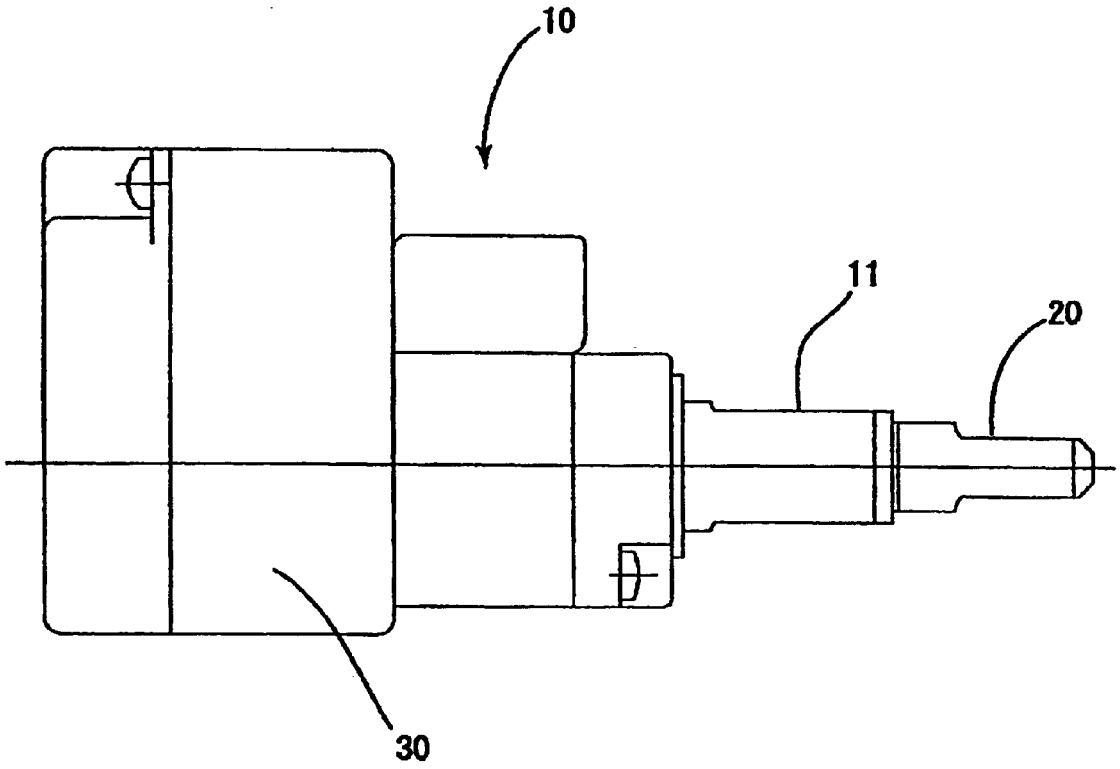
FIG. 2 is a top view illustrating the external appearance of the toilet cover opening/closing device applied to the toilet seat unit of FIG. 1.

FIG. 1 is a diagram illustrating a toilet unit having a toilet cover opening/closing device of an embodiment of the present invention. FIG. 2 is a plan view illustrating the external appearance of the toilet cover opening/closing device of this embodiment. In light of each component arranged within the toilet cover opening/closing device, FIG. 3 is a top view illustrating the layout of the mechanism components and FIG. 4 is an expanded diagram of FIG. 3.

Toilet 1 illustrated in FIG. 1 comprises: a toilet body 2; a water tank 3; and a toilet seat unit 4. Toilet seat unit 4 generally comprises: a toilet seat 5; a toilet cover 6; and a body cover 7. Body cover 7 is built into the toilet cover opening/closing device 10 as illustrated in FIG. 2. Toilet cover opening/closing device 10 has projections having a toilet seat lever 11 connected to toilet seat 5; and a rotary shaft 20 pivotally connected to toilet cover 6 in a manner that toilet seat lever 11 and rotary shaft 20 project outward from unit casing 30.

Toilet opening/closing device 10 motor drives toilet cover 6 with a fully opened position indicated by a solid line LA to an inclined position marked by a dotted line LB in the middle of the closing motion, where toilet cover 6 enters self-weight initiated rotational motion all the way to the fully closed position where it rests on toilet seat 5.

Figure 3:
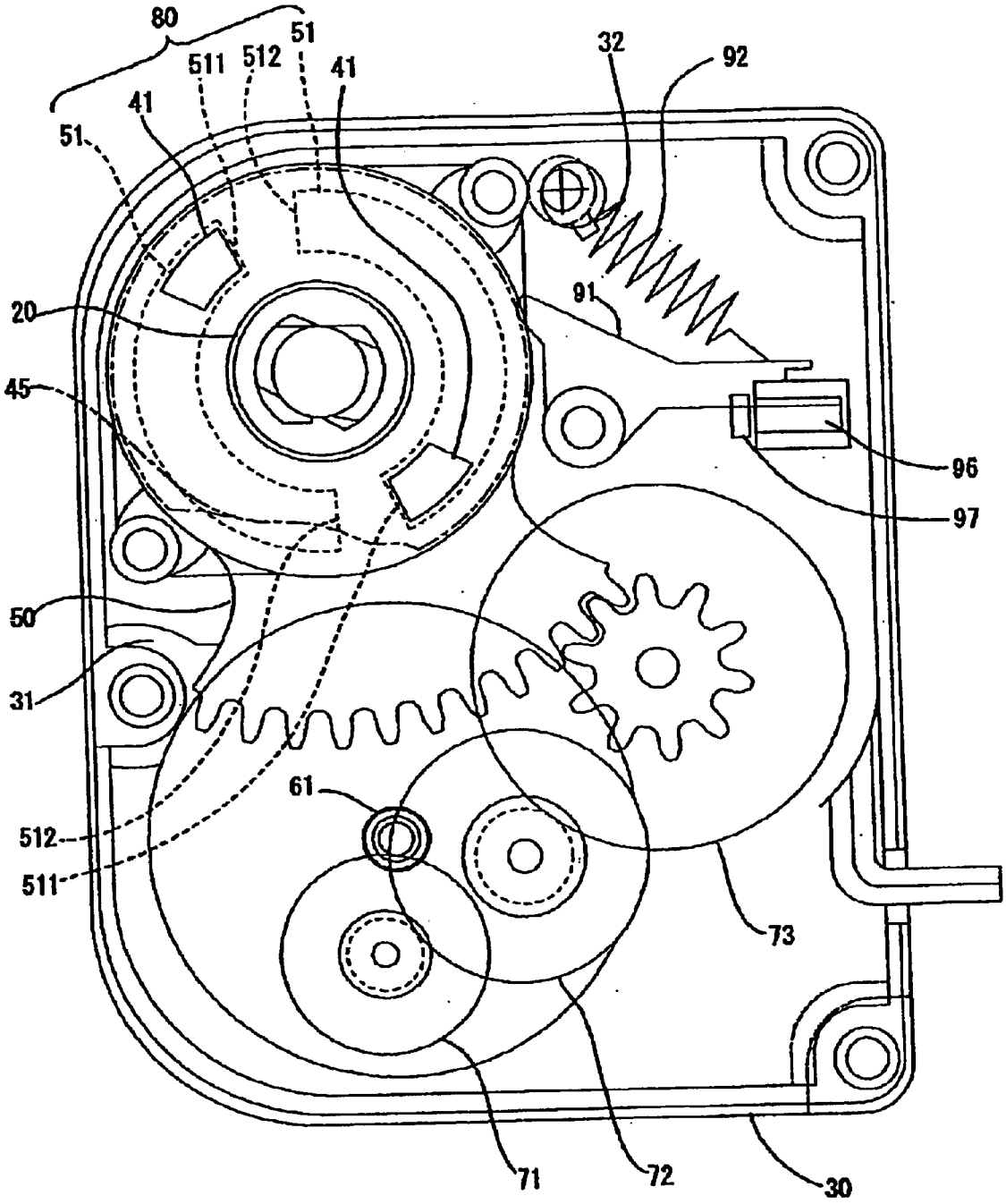
FIG. 3 is a top view illustrating the layout of components in the toilet cover opening/closing device of FIG. 2.
Figure 4:
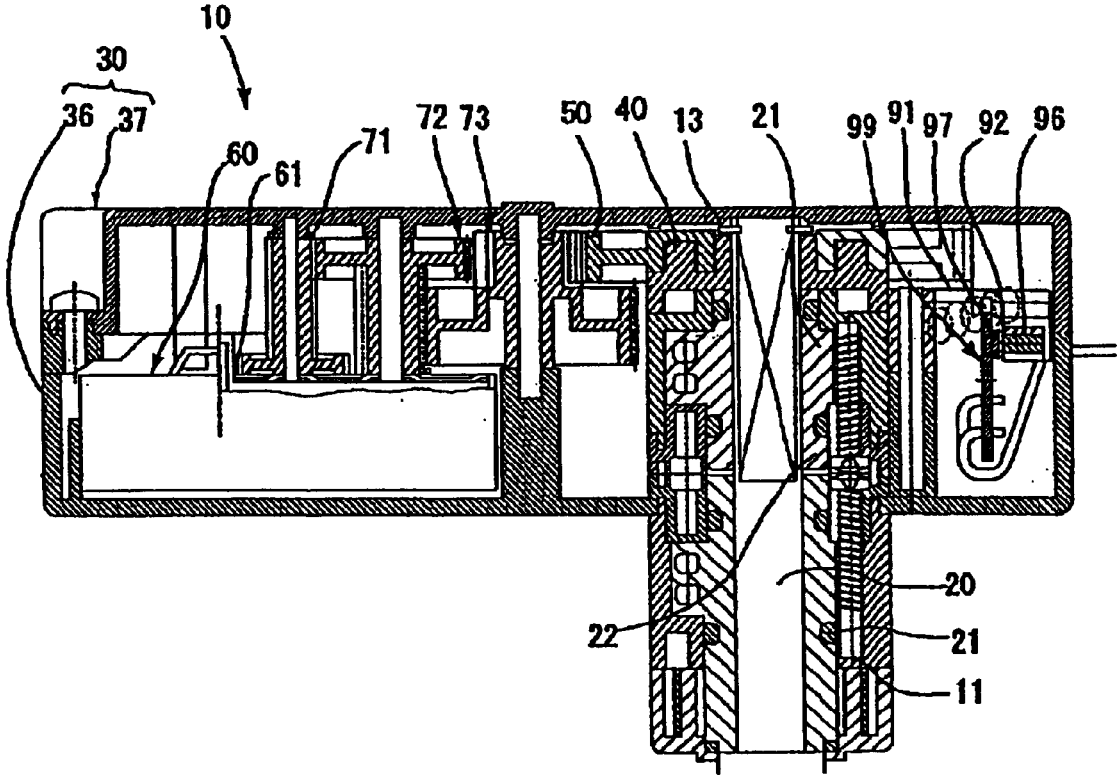
FIG. 4 is an extended (cross sectional) diagram illustrating a layout of the components of the toilet cover opening/closing device of FIG. 2.

As illustrated in FIGS. 3 and 4, toilet cover opening/closing device 10 comprises an oil damper 21 to accommodate seat lever 11 such that toilet cover 6 does not fall all of a sudden even though the user lets go of toilet seat 5 to return toilet seat 5 to rest on toilet body 2.

Toilet cover opening/closing device 10 comprises another oil damper 21 to accommodate rotary shaft 20 as well such that toilet cover 6 does not fall all of a sudden even though the user lets go of toilet seat 5 in an attempt to return toilet cover 6 back onto toilet seat 5.

In unit casing 30 of toilet opening/closing device 10, a disk-shaped coupling gear 40 (slave member) is connected to rotary shaft 20 toward the base end thereof via (through) an E-shaped stop ring 13. In unit casing 30, a stepping motor 60, the driving source, that can rotate in a reversed manner is arranged to rotate toilet cover 6 via (through) coupling gear 40.

Unit casing 30 comprises: an upper casing 36 and a lower casing 37. The motor casing and the board accommodating stepping motor 60 are secured utilizing circular ribs on upper casing 36 and groove-like ribs (on lower casing 37).

On the power transfer path defined by the output shaft of stepping motor 60 and the coupling gear 40 are arranged pinion 61 fixed onto the output shaft of stepping motor 60; first gear 71 meshed with pinion 61; second gear 72 meshed with the pinion on first gear 71; third gear 73 meshed with the pinion of second gear 72; and sector gear 50 meshed with the pinion of third gear 73. In the space defined by sector gear 50 and coupler gear 40 is arranged a switching mechanism 80 that mechanically connects or disconnects sector gear 50 with coupler gear 40. Note that the circular shape of the base of sector gear 50 is concentric to and leveled with coupler gear 40 such that the circular portion can rotate around the common center axis.

In switching mechanism 80 of this embodiment, on the surface of gear sector 50 are provided two grooves 51 of circular concavity in such a manner that they are symmetric to and concentric to the central axis of rotation wherein the face of sector gear 50 faces coupling gear 40. On sector gear 50 toward coupling gear 40 are formed two projections 41 that fit into each of the two grooves 51.

Now, FIG. 3 illustrates toilet cover 6 in the fully opened position as indicated by a solid line LA in FIG. 1. When toilet cover 6 is in the fully opened position, one of each edges 511 or 512 contacts projection 41 wherein edge 511 is provided at the clockwise end of groove 51 while edge 512 is provided at the counterclockwise end of groove 51.

A cam unit is provided at the lower end of coupling gear 40 and lever 91 with a cam follower, arranged at the side of coupling gear 40. Lever 91 is rotatably arranged around the shaft and has a contact point that contacts cam surface 45 provided on the outer circumference of coupling gear 40. Lever 91 is further coupled with one end of coil spring 92 at the opposite end of the contact point. The other end of coil spring 92 is attached to projection 41 in the casing. The contact point of lever 91 being pressed by tension spring 92 thus elastically contacts cam surface 45.

Magnet 96 is fixed onto one edge of lever 9 and a sensor 97 made of a hole IC packaged in circuit board 99 (FIG. 4) is provided at a point opposite to magnet 96. As coupling gear 40 rotates from the state illustrated in FIG. 3, lever 91 rocks in response to the rotation. This motion changes the position of magnet 96 that is fixed onto lever 91. Sensor 97 detects such a motion (of magnet 96). This characteristic allows sensor 97 to detect the angle or position of coupling gear 40, in other words, whether toilet cover 6 is opened or closed. Cam surface 45 is concave at 30 degrees, at which sensor 97 switches the output signal before the fully closed position.

In the switching mechanism 80 of toilet cover opening/closing device 10 configured in the manner described above, groove 51 is provided within a range of 157 degrees and projection 41 occupies about 30 degrees, leaving 127 degrees for idling between groove 51 and projection 41.

In this embodiment, toilet cover 6 is set up (programmed) as follows: in the fully opened position, toilet cover 6 moves 30 degree backward viewed from the upright position. As stepping motor 60 rotates toilet cover 6 by 60 degrees in the closing direction, toilet cover 6 reaches the inclined starting position, which is an additional 30 degrees forward, and then, the self-weight initiated rotational motion brings toilet cover 6 to the fully closed position.

On the inner surface of unit casing 30 are provided two stoppers 31 and 32 that mechanically define the original position and the end position of sector gear 50 as sector gear 50 rotates from the fully opened position to the inclined starting position.

Figures 5A, 5B, 5C:
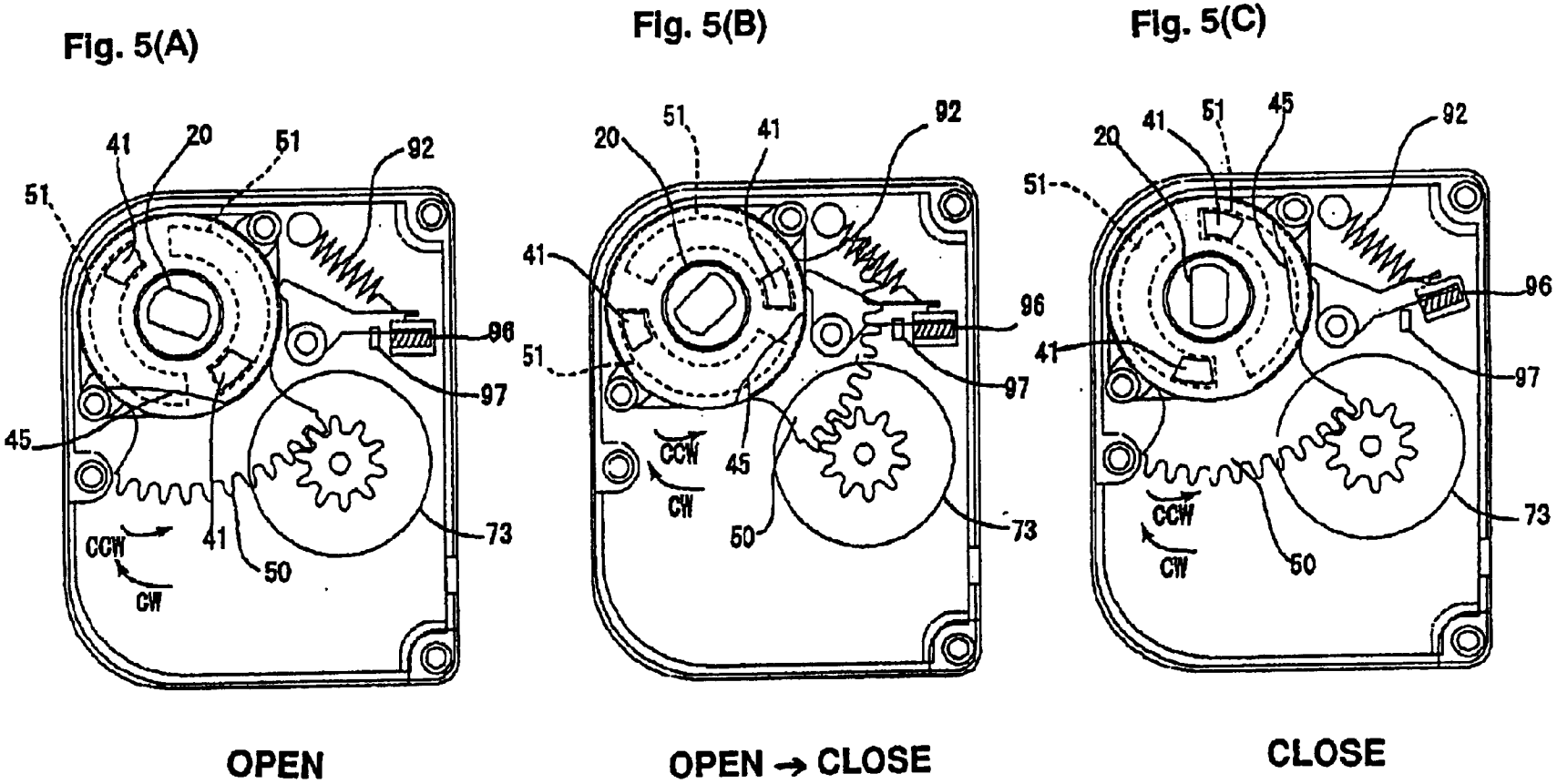
FIG. 5(A), FIG. 5(B), and FIG. 5(C) are diagrams describing the operation of the toilet cover opening/closing device of an embodiment of the present invention; wherein FIG. 5(A), FIG. 5(B), and FIG. 5(C) correspond to the fully opened position, an inclined starting position, and the fully closed position, respectively.

FIG. 5(A), FIG. 5(B), and FIG. 5(C) are diagrams describing the operation of the toilet cover opening/closing device of this embodiment, each FIG. 5(A), FIG. 5(B), and FIG. 5(C) corresponding to the fully opened position, the declination starting position, and the fully closed position respectively.

In toilet cover opening/closing device 10 of this embodiment, when toilet cover 6 is in the fully opened position, as illustrated in FIG. 5(A), projection 41 of coupling gear 40 is positioned near one end 511 of groove 51 provided on sector gear 50 and cam surface 45 pushes away the contact point of lever 91 such that magnet 96 is positioned in proximity of sensor 97.

In this state, when sensor 97 in toilet cover opening/closing device 10 of the toilet seat unit 4 detects that toilet cover 6 is kept open clockwise without being used for a given time period, stepping motor 60 rotates by a given number of steps or for a given time period. As a result, the torque of the output shaft is transmitted to first gear 71, second gear 72, third gear 73, and sector gear 50 such that sector gear 50 rotates 60 degrees counterclockwise as illustrated in FIG. 5(B). This is the end point for sector gear 50. During the rotation, one end 511 of groove 51 pushes projection 41 of coupling gear 40 in groove 51 of sector gear 50 while coupling gear 40 rotates 60 degrees and toilet cover 6 rotates to reach the inclined starting position, which is 30 degrees toward the front.

From the above state, toilet cover 6 reaches the fully closed position by its own weight. In response to this motion, projection 41 of coupling gear 40 further rotates 60 degrees counterclockwise as illustrated in FIG. 5(C). However, as a sufficient idle space is provided in the space between groove 51 on sector gear 50 and projection 41, sector gear 50 and projection 41 do not interfere with each other. Between sector gear 50 and coupling gear 40, only coupling gear 40 corresponds to the motion of toilet cover 6.

Further, cam surface 45 provided on coupling gear 40 also rotates counterclockwise during the self-weight initiated rotary motion of toilet cover 6, as a result, lever 91 rotates causing magnet 96 to be distanced from sensor 97 at a point 30 degrees above the fully closed position. The signal output from sensor 97 is thus switched. The output signal reaches sensor 97, which detects the closure of toilet cover 7.

While toilet cover 6 rotates to the fully closed position, stepping motor 60 spinning in a reversed mode rotates sector gear 50 by 60 degrees counterclockwise to return sector gear 50 to its original position as illustrated in FIG. 5(C). Given a sufficient idle space between groove 51 on sector gear 50 and projection 41, sector gear 50 and projection 41 do not interfere with each other in this case either. Between sector gear 50 and coupling gear 40, only coupling gear 40 returns to its original position.

As a user manually opens toilet cover 6 from the state illustrated in FIG. 5(C), coupling gear 40 rotates in response to the rotary motion of toilet 6 from the position of FIG. 5(C) to that of FIG. 5(A). During the rotation, sector gear 50 and projection 41 do not interfere with each other. Between sector gear 50 and coupling gear 40, that are linked to stepping motor 60 or an array of gears respectively, only coupling gear 40 returns to its original position.

The toilet cover opening/closing device 10 thus described in the above embodiment drives toilet cover 6 by stepping motor 60 via (through) sector gear 50, coupling gear 40, and rotary shaft 20. Toilet cover 6 rotates 60 degrees from the fully opened position to the inclined starting position, then, it falls by the weight of toilet cover 6 itself. During the closing motion, the rotary motion responds to the torque generated by the weight of toilet cover 6 which is independent of sector gear 50. Afterwards, toilet cover 6 is rotated by motor 60 from the fully opened position to the inclined starting position. Alternately, motor 60 may be reversed as toilet cover 6 rotates from the fully opened position to the inclined starting position such that sector gear 50 is returned to its original position in a manner such that the motion of sector gear 50 is independent of coupling gear 40. Yet alternately, when a user manually opens toilet cover 6, coupling gear 40 returns to its original position in response to the rotary motion of toilet cover 6. However, sector gear 50 and projection 41 do not interfere with each other during the rotation, eliminating the change of overloading sector gear 50 connected to stepping motor 60 or an array of gears. The force required for manually opening toilet cover 6 is thus minimized.

Moreover, the mechanism configured in the above manner helps to mechanically connect or disconnect sector gear 50 and coupling gear 40 utilizing groove 51 provided on sector gear 50 and projection 41 provided on coupling gear 40. Consequently, the mechanism provides an easy means for controlling the motor and can be inexpensively manufactured.

Further in this embodiment, toilet cover 6 is driven by stepping motor 60. When a user manually opens toilet cover 6 during closing motion driven by the motor, stepping motor 60 loses synchronism or does not rotate. This allows the user to handle toilet cover 6 with minimum force even though toilet cover 6 is moved in the reverse direction (upward, opening direction) while the motor is driving the toilet cover 6 in the downward, closing direction.

Further more, stoppers 31 and 32 are provided as a part of unit casing 30 wherein stoppers 31 and 32 mechanically define the starting position and the ending position of sector gear 50 as sector gear 50 rotates from a fully opened position to an inclined starting position: for example, when a manual opening motion occurs in the middle of the motor driven closing motion and displaces the driving member from the target point that meets the duration of conduction, stopper 31 initializes sector gear 50 to return sector gear 50 to its original position utilizing the reversed spin of the motor. Thus, the motor repeatedly produces an accurate motion all the time as long as its steps or timer is controlled.

In the above embodiment, sector gear 50 and coupling gear 40 share the same axial center and a switching mechanism 80 is arranged therebetween. However, a switching mechanism may be constructed with a driving member and a slave member having a separate axial center.

As described above, to close a toilet cover that is kept open by clockwise motion of a motor, the present invention accomplishes the task in the following manner: a driving member connected to the motor end and a slave member connected to the toilet cover at the rotary shaft end are mechanically connected to each other. Therefore, a motor drives the closing motion of the toilet cover. When the toilet cover rotates to an inclined starting position at which the toilet cover's self-weight initiates the closing motion, a switching mechanism disconnects the mechanical connection between the driving member and the slave member. The slave member, thus, responds to the self-weight initiated rotary motion of the toilet cover independent of the driving member while the driving member returns to its original position where the toilet cover is in a fully opened position independent of the slave member taking advantage of the reversed spin of the motor. For this reason, as a user manually opens a toilet cover, the slave member moves in response to the motion of the toilet cover but the driving member connected to the output shaft end of the motor does not respond to such a motion. The user can thus handle the toilet cover with little force. Moreover, the toilet cover moves in the closing direction as long as the mechanical connection between the driving member and the slave member is released. Consequently, the motor can be controlled easily and the toilet cover opening/closing device can be manufactured cost effectively.

The foregoing specific embodiments represent just some of the ways of practicing the present invention. Many other embodiments are possible within the spirit of the invention. Accordingly, the scope of the invention is not limited to the foregoing specification, but instead is given by the appended claims along with their full range of equivalents.

What is claimed is:

1. A toilet cover opening/closing device for a toilet unit having a toilet cover comprising:

a rotary shaft for moving said toilet cover; and a driving means for rotating said rotary shaft to provide a rotational motion to said toilet cover from an inclined starting position wherein said toilet cover starts rotating in a closing direction under its own weight, said driving means further comprising:

a motor that is rotatable both clockwise and counterclockwise;

a driving member that is connected to the output shaft end of said motor;

a slave member that is connected to said rotary shaft end; and a switching mechanism mechanically connecting or disconnecting said driving member from said slave member;

wherein, when said motor rotates clockwise to move said toilet cover from a fully opened position to the inclined starting position, said switching mechanism allows said slave member to move in response to said driving member; after said toilet cover reaches said inclined starting position, the mechanical linkage between said driving member and said slave member is released such that said slave member moves by self-weight initiated rotary motion of said toilet cover independent of said driving member while said driving member returns to its fully opened position in said toilet cover independent of said slave member taking advantage of said motor's reversed spin.

2. A toilet cover opening/closing device as set forth in claim 1 wherein, in said switching mechanism, said driving member pushes said slave member to move said toilet cover from said fully opened position to said inclined starting position, wherein said slave member and said driving member do not interfere with each other as long as said toilet cover's self-weight initiates the motion of said slave member defined by said inclined starting position and said fully closed position.

3. A toilet cover opening/closing device as set forth in claim 1 wherein said switching mechanism has a structure in which a groove is provided on said driving member in such a manner that a part of said slave member makes a relative linear motion therein to move in response to said driving member when said toilet cover moves from said fully opened position to said inclined starting position;

wherein the shape and length of said groove from said one edge to the other edge is set so as to cause the following:

said motor's reversed spin provides said slave member a rotational motion independent of said driving member after said toilet cover rotates from said fully opened position to said inclined starting position; and said driving member is capable of returning to its original position independent of said slave member.

4. The toilet cover opening/closing device as set forth in claim 1 wherein said toilet cover further comprises a shock absorber for applying a resisting force to the self-weight initiated rotational motion exercised in the closing direction thereby slowing down the speed of said self-weight initiated rotational motion that occurs between said inclined starting position and said fully closed position.

5. The toilet cover opening/closing device as set forth in claim 1 wherein said motor is a stepping motor.

6. The toilet cover opening/closing device as set forth in claim 1 wherein said toilet cover further comprises a stopper that mechanically defines the original position and the end position of said driving member, which is in line with the rotational motion of said driving member that occurs between said fully opened position and said inclined starting position.

7. A toilet cover closing device for a toilet unit having a toilet cover, the toilet cover having an open position, a partially closed position and a closed position, the toilet cover closing device comprising:

a slave member connected to the toilet cover;

a motor rotatable in a first direction and a second direction opposite to the first direction; and a switching mechanism operable to mechanically connect or disconnect the motor from the slave member;

wherein, when the motor rotates in the first direction to move the toilet cover from the open position to the partially closed position, the switching mechanism allows the slave member to move in response to rotation of the motor; and after the toilet cover reaches the partially closed position, the mechanical link between the slave member and the motor provided by the switching mechanism is released such that the toilet cover falls freely under its own weight to the closed position independent of the motor.

8. The toilet cover closing device according to claim 7, further comprising a driving member coupled between the motor and the switching mechanism and operable to move the slave member, wherein the motor rotates in the second direction to return the driving member to a position corresponding to the open position of the toilet cover such that during opening of the toilet cover, the slave member is mechanically disconnected from the driving member to reduce the amount of force required to open the toilet cover.

9. The toilet cover closing device according to claim 7, further comprising a driving member coupled between the motor and the switching mechanism and operable to move the slave member, wherein the motor rotates in the second direction to return the driving member to a position corresponding to the open position of the toilet cover while the toilet cover falls freely under its own weight to the closed position.

10. The toilet cover closing device according to claim 9, further comprising a sensor that detects a predetermined position of the toilet cover between the partially closed position and the closed position, wherein the motor rotates in the second direction to return the driving member upon detection of the predetermined position by the sensor.

11. A toilet cover closing device according to claim 9, wherein:

the switching mechanism includes a groove provided on the driving member such that the slave member moves in response to the driving member when the toilet cover moves from the open position to the partially closed position; and the groove from one edge to the other edge is shaped and sized to cause the following:

rotation of the motor in the second direction provides the slave member with a rotational motion which is independent of the driving member while the toilet cover falls freely under its own weight to the closed position; and the driving member is capable of returning to a position corresponding to the open position of the toilet cover independent of the slave member.

12. The toilet cover closing device according to claim 9, further comprising a stopper that mechanically defines the original position and the end position of the driving member, which is in line with the rotational motion of the driving member that occurs between the open position and the partially closed position.

13. A toilet cover closing device for a toilet unit having a toilet cover, the toilet cover having an open position, a partially closed position and a closed position, the toilet cover closing device comprising:

a rotary shaft connected to the toilet cover;

a slave member connected to the rotary shaft to rotate the rotary shaft;

a motor rotatable in a first direction and a second direction opposite to the first direction;

a driving member operable to be driven by the motor; and a switching mechanism operable to mechanically connect or disconnect the driving member from the slave member;

wherein the motor rotates in the first direction to drive the driving member and the slave member to move the toilet cover from the open position to the partially closed position; and after the toilet cover reaches the partially closed position, the mechanical link provided by the switching mechanism between the driving member and the slave member is released to allow the toilet cover to fall freely under its own weight to the closed position independent of the driving member.

14. The toilet cover closing device according to claim 13, further comprising a driving member coupled between the motor and the switching mechanism and operable to move the slave member, wherein the motor rotates in the second direction to return the driving member to a position corresponding to the open position of the toilet cover while the toilet cover falls freely under its own weight to the closed position.

15. The toilet cover closing device according to claim 13, further comprising a sensor that detects a predetermined position of the toilet cover between the partially closed position and the closed position, wherein the motor rotates in the second direction to return the driving member upon detection of the predetermined position by the sensor.

* * * * *